United States Patent [19]

Thoma et al.

[11] Patent Number: 4,635,535

[45] Date of Patent: Jan. 13, 1987

[54] HYDRAULIC RADIAL PISTON MACHINES

[75] Inventors: Christian H. Thoma, St. Clement; George D. M. Arnold, St. Helier, both of Great Britain

[73] Assignee: Unipat AG, Glarus, Switzerland

[21] Appl. No.: 536,152

[22] PCT Filed: Jan. 14, 1983

[86] PCT No.: PCT/EP83/00008

§ 371 Date: Sep. 6, 1983

§ 102(e) Date: Sep. 6, 1983

[87] PCT Pub. No.: WO83/02482

PCT Pub. Date: Jul. 21, 1983

[30] Foreign Application Priority Data

Jan. 19, 1982 [GB] United Kingdom ..... 8201456

[51] Int. Cl.[4] ..... F01B 13/06

[52] U.S. Cl. ..... 91/498; 91/491

[58] Field of Search ..... 91/486–488, 91/491, 492, 497, 498; 417/273

[56] References Cited

U.S. PATENT DOCUMENTS

| | | | |
|---|---|---|---|
| 1,987,781 | 1/1935 | Maw | 91/498 |
| 2,427,325 | 9/1949 | Ferris | 91/498 X |
| 2,473,271 | 6/1949 | Benedek | 91/498 X |
| 3,081,708 | 3/1963 | Nyman et al. | 91/492 |
| 3,087,437 | 4/1963 | Henrichsen | 91/498 X |
| 3,295,459 | 1/1967 | Griffith | 91/488 X |
| 3,750,533 | 8/1973 | Thoma | 91/498 |
| 3,940,819 | 3/1976 | McMackin et al. | 91/498 X |
| 3,961,562 | 6/1976 | Kersten et al. | 91/492 |
| 4,148,249 | 4/1979 | Jacobs et al. | 91/488 X |

FOREIGN PATENT DOCUMENTS

| | | | |
|---|---|---|---|
| 2161328 | 7/1972 | Fed. Rep. of Germany | 91/498 |
| 2243138 | 3/1974 | Fed. Rep. of Germany | 417/273 |
| 2436627 | 2/1976 | Fed. Rep. of Germany | 91/491 |
| 2284752 | 4/1976 | France | 91/488 |
| 43207 | 1/1960 | Poland | 91/498 |
| 12574 | of 1909 | United Kingdom | 91/492 |
| 1141855 | 2/1969 | United Kingdom | 91/498 |

*Primary Examiner*—Carlton R. Croyle
*Assistant Examiner*—Paul F. Neils
*Attorney, Agent, or Firm*—Young & Thompson

[57] ABSTRACT

A hydraulic radial piston pump or motor comprises a rotary cylinder unit (20) mounted to rotate on a fixed pintle (25), the unit (20) having radial cylinder bores formed by cylinder sleeves (23) each housing a piston (40) connected by a ball joint (44) to a slipper (45) engaging a surrounding annular track ring (47). The unit (20) also includes a separately formed central sleeve (21) having ports (26) cooperating with ports (31,32) in the pintle, the pintle ports (31,32) and the sleeve ports (26) being elongated in a circumferential direction. The pintle has three parallel flow passages, two (28') of smaller diameter than the third (27'). The slippers (45) are held resiliently against the track ring (47) by a band (66) having windows (68) which fit the slippers, the band being of resilient material and split at one point. The cylinder unit (20) has a rounded external surface and is free to float in an axial direction which provides a self-centering effect.

4 Claims, 15 Drawing Figures

HYDRAULIC RADIAL PISTON MACHINES

Figure 1:
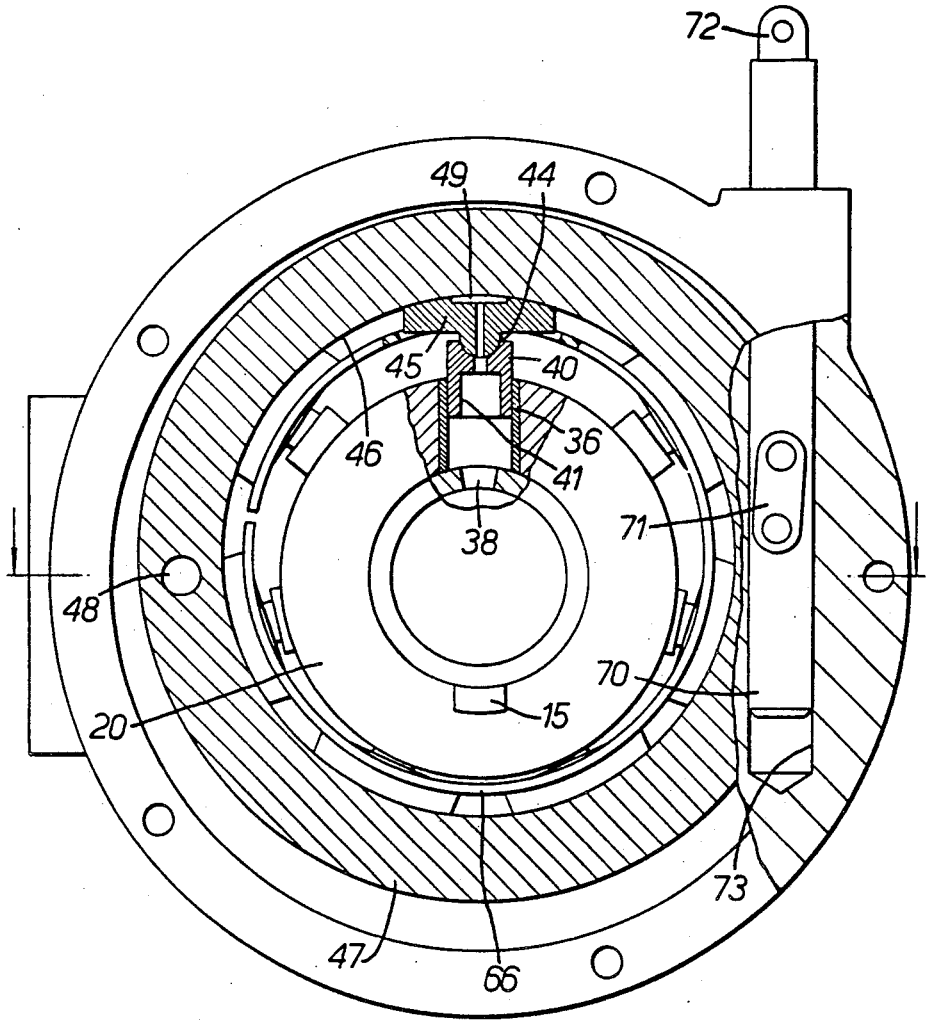

This invention relates to rotary radial piston hydraulic pumps and motors which are for convenience herein referred to as "hydraulic machines".

A rotary radial piston machine may be defined for the purposes of this specification as including a rotary cylinder unit surrounding and mounted to rotate on a ported pintle. The cylinder unit includes a number of generally radial cylinders each containing a piston and each piston engages a slipper which contacts a surrounding annular track ring. The ports in the pintle are connected to external fluid inlet and outlet passages and thus rotary movement of the cylinder unit is accompanied by radial displacement of the pistons and corresponding displacement of fluid through the passages. Existing radial piston hydraulic machines suffer from a number of problems and disadvantages and it is an object of the invention to provide an improved radial piston design which will at least partly overcome the existing difficulties.

One of the problems concerns the positioning of the rotary cylinder unit in an axial direction on the pintle. According to a first aspect of the invention the cylinder unit is free to float (within limits) in an axial direction.

Surprisingly it is found that this freedom to float is quite acceptable since the cylinder unit can be designed to provide a self-centering or positioning effect. Thus, according to a preferred feature of the invention the opposing end faces of the cylinder unit and/or the casing are inclined towards the axis or otherwise shaped to provide a hydrodynamic self-centering effect.

Another problem arises from the eccentric position of the track ring with respect to the pintle. It follows that the enclosed fluid volume between adjacent pistons is continually changing during each revolution and the hydraulic fluid in these zones is continually displaced at high speed, which can cause fluid friction and internal energy losses. According to another aspect of the invention the cylinder unit is formed with a smooth rounded external contour to reduce turbulence and encourage fluid flow around the unit.

The cylinder unit may have rounded corners, thus reducing "wetted surface" area and encouraging oil transfer, and conveniently the opposite axial end faces of the cylinder unit are at least partly inclined in relation to the end faces of the casing. Alternatively or in addition the cylinder unit or its casing may be formed with oil swirl grooves extending circumferentially around the axis to facilitate transfer of oil from one side of the axis to the other as the machine rotates.

Hydraulic machines are often included in complete hydraulic power transmissions, and it is important that the cost of the transmission system should be held to a minimum, but it is equally important that the system should have a satisfactory working life. These requirements conflict and it is an object of the invention to provide an effective solution or compromise.

Thus, according to a further aspect of the invention the cylinder unit includes a separately formed ported sleeve arranged to communicate with the ports on the pintle and with the cylinders of the rotary unit.

This affords the possibility of a large number of useful design features. By providing a separately formed ported sleeve, it is comparatively easy to design porting and fluid flow passages which will materially improve the performance. Also, the sleeve and the other components of the cylinder unit can be formed in specially selected materials and formed by selected procedures to establish long life, light weight, economy in cost, and other features.

One particular important feature is that the valve porting in the sleeve may include non-circular ports which are elongate and extended in a circumferential direction. This is a fundamentally novel approach. Conventionally the ports in the cylinder unit are circular and produced by drilling, but if the sleeve is formed separately the ports can be made elongate. It follows that for any particular port area a narrower longer port is possible Since the axial width of the pressure land around the port is determined by hydraulic considerations involving leakage losses, it follows that the axial length of the pintle can then be reduced slightly, usually accompanied by a small increase in pintle diameter. This in turn strengthens the pintle and reduces the cantilever arm and therefore the bending moments applied to the pintle by the radial piston forces.

Problems exist in radial piston machines arising from the closing of the ports to the pistons as the ports move between the high and low pressure ports of the pintle. During this movement there is an appreciable further movement of each piston which can create most undesirable noise, vibration and loss of efficiency. Any solution to the problem should preferably be such that the bidirectional qualities are not affected and according to another preferred feature of the invention the ports in the rotary sleeve of the cylinder unit have irregular end shape profiles. In a particular preferred construction the end profile of each port in the sleeve is extended to a point or to a small separate port. According to another preferred feature of the invention the ports in the pintle sleeve are arranged to overlap or nearly overlap so as to reduce or eliminate the "dead area" over which each individual cylinder is closed. It is also of advantage if the pintle sleeve is formed externally of polygonal shape. This assists in locating the individual radial cylinders on the sleeve.

According to another preferred feature of the invention the pintle sleeve is separately formed and attached to the body of the unit by casting or welding, or a press fit. By making the pintle sleeve separately it is also possible to use different materials for different parts and according to another preferred feature of the invention the pintle sleeve is formed in metal, e.g. bronze, and the cylinder unit is formed in a lightweight material such as plastics or lightweight alloy.

From yet another aspect the invention consists in a radial piston machine comprising a rotary cylinder unit surrounding a ported pintle, the pintle having a non-circular circumferentially elongated port to co-operate with a non-circular circumferentially elongated port in the rotary cylinder unit. The combination of non-circular ports in the pintle and the pintle sleeve offers remarkable advantages as will be explained in the following text.

A conventional pintle has two or four internal parallel flow passages which may be formed by drilling or by internal coring if the pintle is cast. It is difficult to maintain adequate strength in the pintle, and also difficult to provide the optimum flow cross-section and passage profile. In addition, the manufacturing cost is increased if an excessive number of passages have to be drilled. Now according to another aspect of the invention the pintle is formed with three internal flow passages communicating with control ports in its external surface, two passages being of smaller cross-section than the third and the two being linked or coupled to form a common passage.

Preferably the three passages are so formed and positioned on the corners of an isosceles triangle to provide maximum flow cross-section coupled with maximum mechanical strength in the pintle.

The design and manufacture of the pistons and slippers and their connections is of great importance and according to another aspect of the invention each piston is connected to a slipper which engages a surrounding track ring, the connections between the slippers and pistons including ball joints with the centre of each balljoint located radially outside the end of the respective piston. The connection between each slipper and piston may be both a mechanical connection and a fluid transfer duct.

Conventionally the pistons in radial piston machines are urged outwards against the cam track by individual springs, but this is expensive and undesirable from several points of view. Now from another aspect of the invention the machine includes a circumferential guide means for controlling or guiding the slippers in relation to the cam track.

Preferably the guide means comprises an incomplete circumferential guide element engaging all of the slippers and the element may be formed with apertures for the individual slippers and intervening bridges. It is particularly desirable that the guide element should be discontinuous circumferentially, and also resilient. Amongst other advantages this eliminates the need for tight manufacturing tolerances and allows for wear and also facilitates assembly. In any case the guide element is preferably out of contact from the cam track and the cylinder unit.

Figure 2:
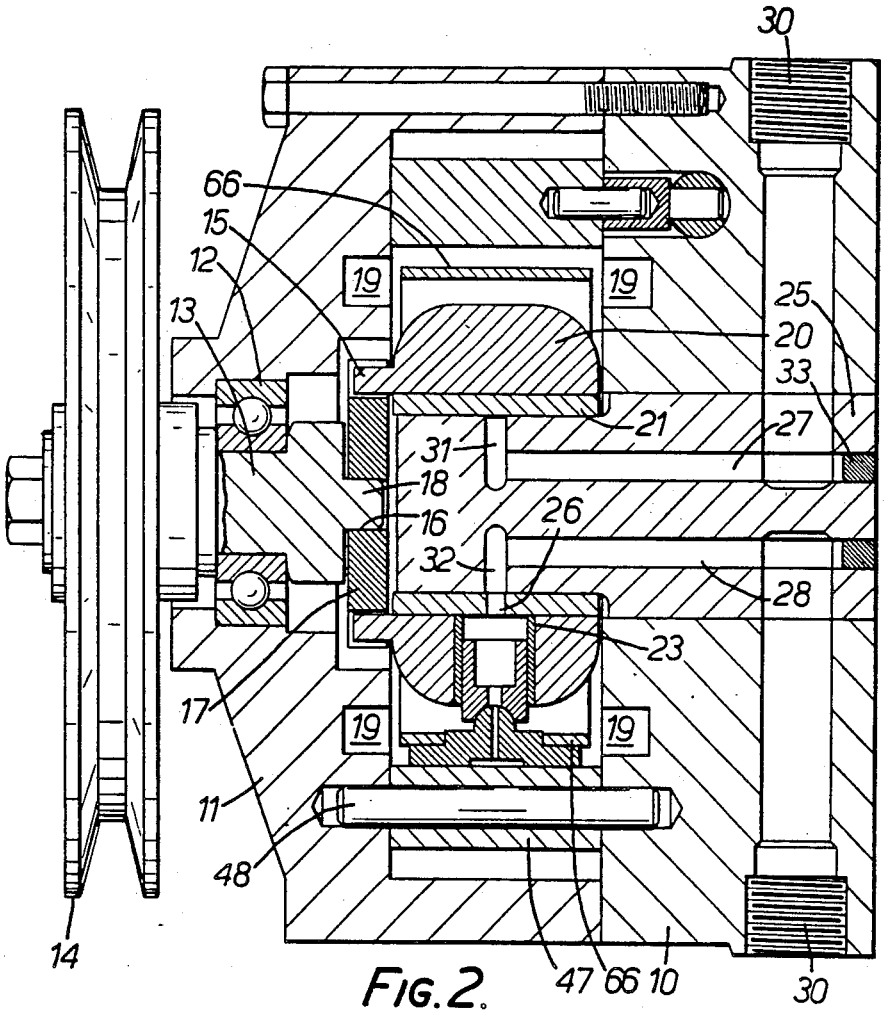
Figure 3:
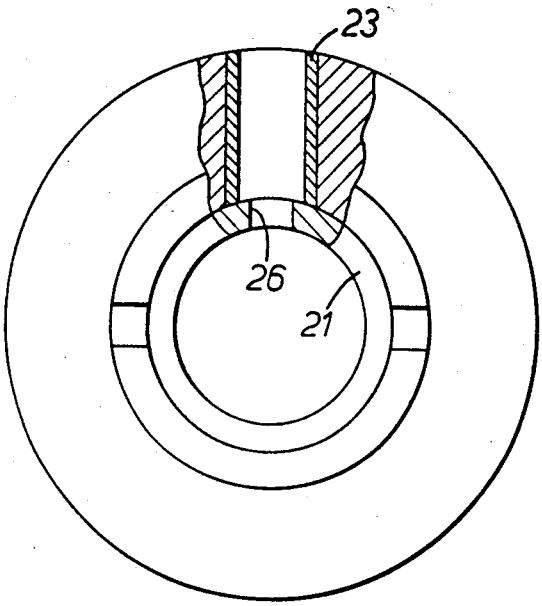
Figure 4:
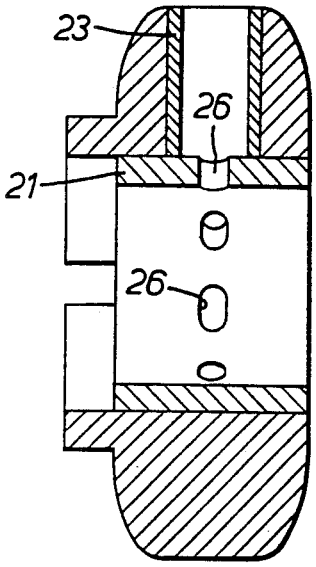
Figure 5:
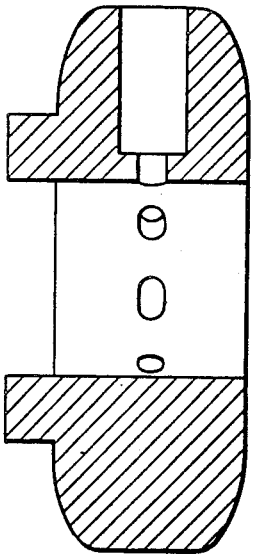
Figure 4A:
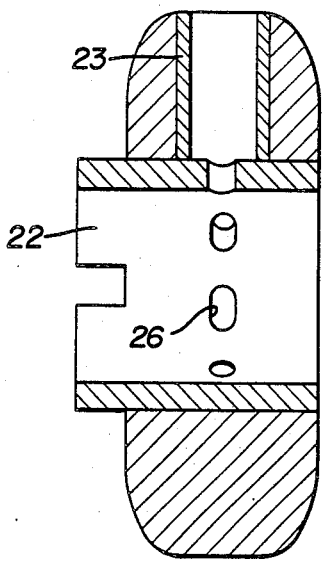
Figure 6:
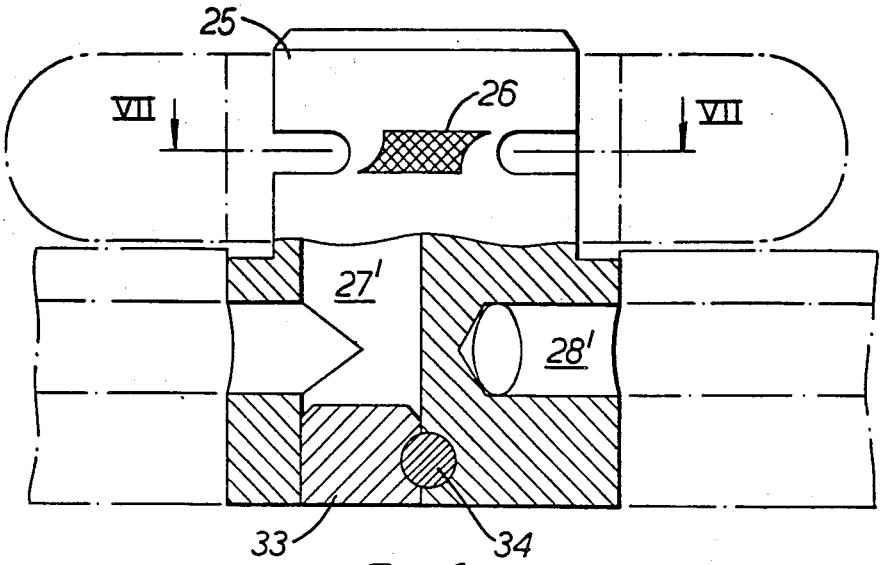
Figure 7:
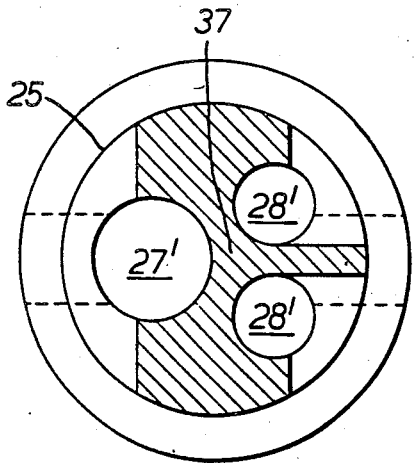
Figure 8:
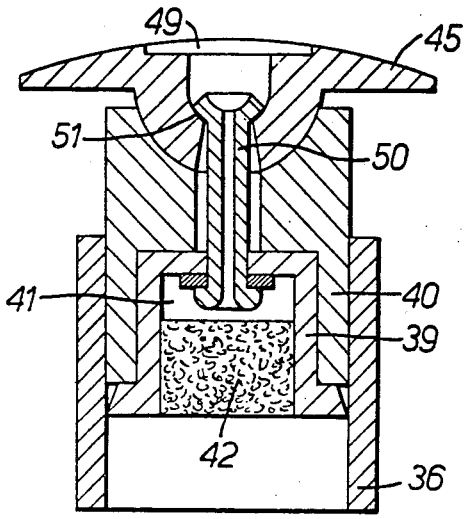
Figure 9:
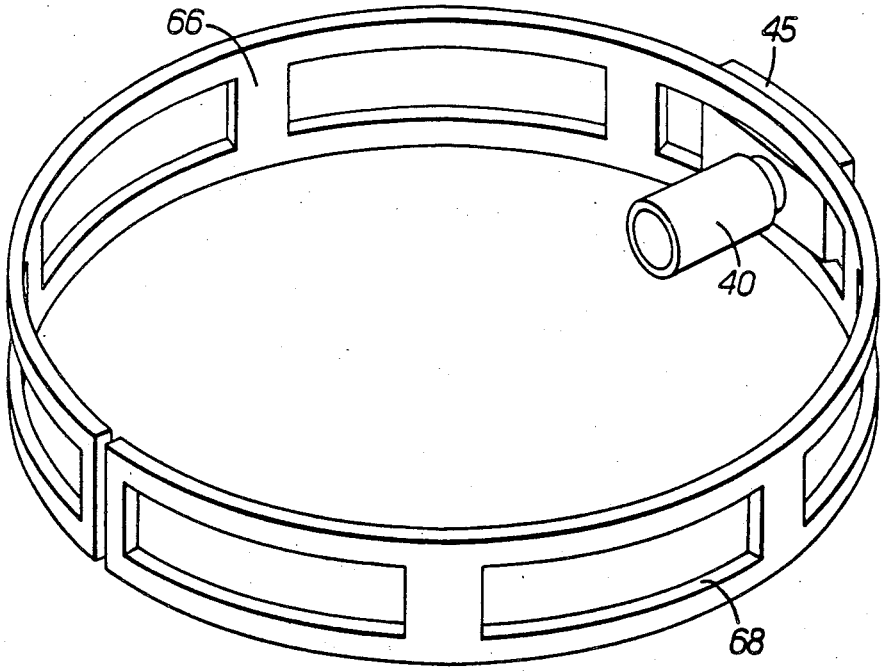
Figure 10:
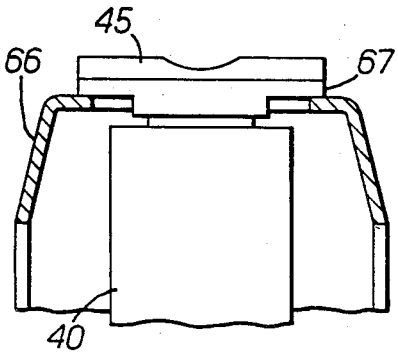
Figure 11:
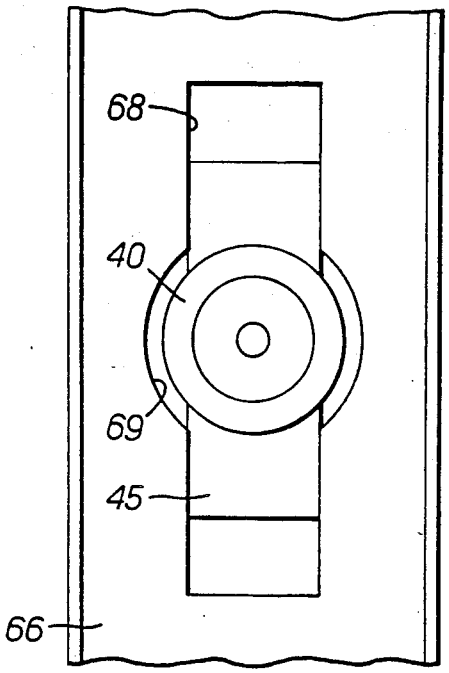
Figure 12:
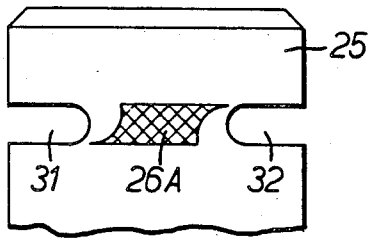
Figure 13:
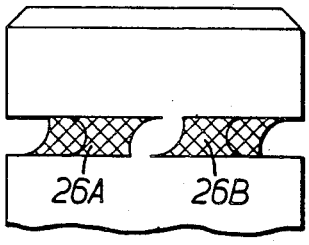
Figure 14:
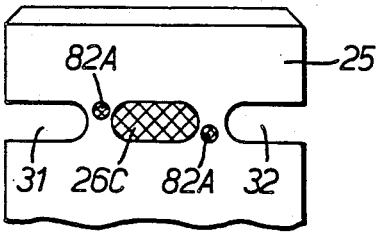

The invention may be performed in various ways and a number of embodiments with modifications will now be described by way of example with reference to the accompanying drawings, in which:

FIGS. 1 and 2 are an end view and sectional side elevation through one form of radial piston machine according to the invention, FIGS. 3 and 4 are respectively an end view and cross-section through one form of rotary cylinder unit according to the invention, FIGS. 4*a* and 5 are views corresponding to FIG. 4 of alternative one-piece constructions, FIG. 6 is a sectional view through another form of machine according to the invention, FIG. 7 is a cross-section on the line VII—VII in FIG. 6, FIG. 8 is a sectional side elevation through a slipper and piston connection according to the invention, FIG. 9 is a perspective view of a slipper guide band according to the invention, FIG. 10 is a cross-sectional view illustrating a slipper in position within an aperture in the guide band, FIG. 11 is a radial "plan" view of the slipper and band, FIG. 12 is a fragmentary side view of a ported pintle according to the invention showing in lattice cross hatching the relationship to one of the moving ports in the pintle sleeve, FIG. 13 is a similar view showing the ports in a different relative position, FIG. 14 is a similar view illustrating a further embodiment.

The first example of the invention illustrated in FIGS. 1 and 2 has the main essential components of any conventional radial piston pump, which are known to those skilled in the art, and do not therefore require detailed description. Essentially the machine comprises a static case formed in two co-operating parts 10 and 11, the latter supporting a bearing 12 in which is mounted a rotary drive shaft 13 having a drive pulley 14. The shaft is connected through an Oldham coupling 15,16,17,18 to a rotary cylinder unit 20 mounted to rotate on a fixed pintle 25 having internal ports 31,32 and flow passages 27,28 connected to external fluid inlet and return lines 30. The cylinder unit includes an internal rotary pintle sleeve 21 surrounding the pintle and the sleeve has ports 38 communicating with seven radial cylinder bores. Each bore includes a cylinder liner or sleeve 23 which is a parallel sided straight through tube and houses a piston 40 with a skirt 41 and a ball socket at its outer end mating with a ball head 44 on the slipper 45, which engages the inner face 46 of an adjustable track ring 47. The track ring is pivoted at 48 on one side of the casing and its eccentricity can be adjusted by means of an adjusting rod 70,72 movable in a transverse guideway on the other side of the casing and connected to the track ring by a pivoted link 71.

By use of the separate pintle sleeve 21, the ports 26 in this sleeve can be elongated, as shown in FIGS. 3 and 4, and likewise the cylinder liner sleeves 23 can be straight parallel through-tubes. Alternatively individual cylinder sleeves may be welded to a central polygonal sleeve or pintle bush, in which case the ports may be rectangular.

In conventional designs the pintle has two cored-in oval section flow passages opening into arcuate pintle ports, and the rotary cylinder block has circular ports to co-operate. In the present invention however there are three drilled flow passages, one 27' of larger diameter and two 28' of smaller diameter which combine as a pair to form the inlet or outlet passage. This provides the best compromise of strength and manufacturing economy, together with optimum flow conditions. The ends of the flow passages are closed by plugs 33, which are located by a transverse cotter pin 34, which also acts as an accurate external guide for positioning the pintle in the casing.

In the piston-slipper design of FIG. 8, the slipper has a circular end flange 45 with a central hydrostatic recess 49, and it is attached to the end of the piston 40 by a hollow rivet 50, which also acts as a fluid conduit supplying lubricating oil to the slipper face from the cylinder or chamber below the piston.

To improve the stability of the slipper it is important that the centre of the ball joint between slipper and piston should be as close as possible to the cylindrical face of the slipper. In the present invention, as shown in FIG. 8, the centre of the ball joint is positioned beyond the end of the piston and closely adjacent to the slipper face, providing optimum stability. This is made possible by forming the ball end on the slipper with the socket on the piston and by the special connecting element 50. A "top-hat" seal 39 is fitted into the skirt of the piston and within the seal is a sintered filter 42 which filters the fuel before it passes through the throttling passage 50 to the face of the slipper. Clearance around the rivet 50 allows for pivotal movement of the slipper but the rivet holds the two together. Thus, if the slipper is pressed radially outwards by a hoop or band (as will be described below) each slipper will draw the associated piston outwards without the need for any piston springs or boost pressure.

The slippers are held out against the cam track ring 47 by the slipper band 66, shown in FIG. 9. This has elongated windows 68 to fit shoulders 67 on the slippers, but there is ample clearance in all directions. The band is formed in one piece but is split at one point and therefore not a complete ring. The joint at the ends may include an overlapping construction of fingers which allow flexing and also permit the band to be opened and closed in assembly, but prevent the two ends of the band moving past each other.

As can be seen from FIGS. 1 and 2, the band 66 holds the slippers radially outwards, but is not in contact with the track ring or the cylinder unit, or the pintle, or the casing. Minimal friction is involved and no extra bearings are required.

If each cylinder port 26 has a straight edge at its leading and trailing end it may cause undesirable rapid pressure fluctuations. These can be alleviated by designing the cylinder ports with irregular end profiles, as illustrated at 26A in FIG. 12. The pointed profile ends provide a gradually opening or closing port as the cylinder unit rotates. FIG. 13 which shows the same construction in a different position illustrates that although the adjacent pointed ends of the ports 26A,26B overlap, there is nevertheless no communication directly between the high pressure supply and relief ports 31,32 in the pintle.

FIG. 14 shows another design providing a similar result by means of small satellite ports 82A,82B which are internally connected to the respective cylinder ports 26C and 26D.

It will be seen that the cylinder barrel 20 is manufactured to provide the minimum resistance to oil flow and to carry the minimum amount of entrapped oil.

Space is provided either side of the cylinder barrel 20 in the axial direction by circular recesses 19 located in the two housings 10 and 11. This results in easing the continuous transfer of oil from the area of the rotating cylinder member 20 to the surrounding cavities inside the machine which lead to a leakage port in the casing (not shown). This oil may alternatively be allowed to move normally to the axis of the pistons into circular grooves around the casing.

The preferred design of the cylinder barrel is (FIG. 4) of rectangular or part-rhomboidal section with the outer corners of the section rounded off.

It will be noticed from FIG. 2 that the smoothly curved cross-section of the cylinder barrel produces opposing end faces on the barrel which are inclined towards the axis, and which combine with the perpendicular end faces of the housing to provide a hydrodynamic self-centering effect on the barrel, in an axial direction.

Manufacture of the cylinder barrel may be carried out in several ways. Traditionally the cylinder bores and pintle bore are machined from solid metal. In the present invention the cylinder barrel may be die cast or moulded in light alloys or "filled" plastics, the bores being left "as moulded" or finished by "ball sizing" or similar operations. Alternatively the cylinders 23 and pintle sleeve 21 may be manufactured separately. In this way all bores are manufactured as through-holes which reduce the cost of close tolerance bores, as shown in FIGS. 3 and 4. The bushes may for example be made as die casting, sintered or turned-bored, with details or finishes produced by cold forging, grinding, broaching or honing. These bushes can then be cast or moulded into a low cost matrix of plastic or light alloy, or may be secured together by welding, brazing, or otherwise. The pintle sleeve may have an integral coupling element, 22 (see FIG. 4*a*), thus assisting further in the manufacturing processes.

Alternatively the cylinder bores may be finished as through-holes in the cylinder barrel which may either be a sintered metal block, or plastic, or light alloy matrix with hard wearing inserts 23. Preferably the barrel is polygonal, the number of sides being proportional to the number of cylinders. This assists in locating the cylinder sleeves.

A conventional pintle is either cast or machined from solid bar, the pintle ports are arcuate and the ports in the pintle sleeve are circular.

In a pintle sleeve design according to the present invention as shown in FIG. 6, specially shaped diamond slots 26 are used as the pintle sleeve valve ports instead of round holes. As a result the pintle may be of larger diameter and shorter length.

Several advantages follow:

(a) the distance between the two ports can be greater (see FIG. 7) giving a stronger section at the weakest point in the pintle 37.

(b) larger flow passage can be accommodated in the pintle due to the larger pintle diameter, resulting in reduced oil velocities, thereby allowing higher rotational speeds of the machine.

(c) the slotted passages in the cylinder barrel sleeve may have larger areas than circular passages, thereby reducing oil velocities at this critical point.

(d) due to the reduced length of pintle there will be a corresponding reduced cantilevered load acting.

The pintle oil galleries and valves may be cast in, but alternatively may be drilled and plugged at one end. Preferably the galleries are formed by three drillings, the largest 27 having the same effective area in terms of oil flow as the two smaller 28. The two smaller drillings form the oil gallery for one port and the single larger drilling that for the other port. With this asymetrical layout larger oil galleries and a stronger pintle section may be provided in a given diameter than with the conventional two or four drillings.

Some noise and loss of power occurs at the changeover from suction to delivery, caused by slight piston movement between the two ports when there is no oil path available for oil to enter or leave the cylinder.

In the present invention these problems have been overcome by shaping the ports (26A) in the die cast insert sleeve (21) such that over the dead spots, a small flow path is always available for the oil. This is shown in FIGS. 12 and 13 by the ports (26A) and (26B). Alternatively, as shown in FIG. 14 an elongated port (26C) and two satellite ports (82A) can be used. With these two designs, if it is deemed necessary to allow a small amount of interport leakage between the pintle ports (31) and (32) then the port (26) can be extended to break into both pintle ports (31) and (32).

Conventionally the philosophy on piston and slipper design has been to reduce leakage flow and reduce the theoretical piston overhang. This has been achieved at the expense of slipper stability and high drag on the slipper, which in turn has unfavourably increased the piston jamming couple. Attempts at slipper guidance made necessary by instability mentioned above has often resulted in more drag, and so higher frictional losses.

In the present invention each piston 40 is in the form of a cylindrical block with a large diameter through-hole and a ball socket less than a radius deep at the head, FIG. 8. An optional recess at the base saves material on sintered components and allows the insertion of optional plastic cylinder base seal 39 of "top hat" section and/or a sintered filter 42 for the oil being fed to the slipper face. This filter also serves to throttle the oil to the slipper hydrostatic bearing. The inclusion of the plastic cylinder seal can mean a relaxation of the tolerances between piston and cylinder bore.

The slipper 45 has a cylindrical outer surface, mating with the track ring, the developed surface being circular or rectangular. A hydrostatic bearing 49 is formed in the outer surface, comprising a circular land round a central well. In the centre of this well is a hole, and a ball socket on the same centre as a ball end on the inner surface of the slipper. Also on the under surface of the slipper are two parallel tracks 67 which engage with the slotted retention band 66 FIGS. 9,10,11. The centre of the ball end is as close to the outer surface of the slipper as possible, making for an extremely stable slipper.

The piston 40 and slipper 45 are held together by a hollow rolled rivet 50 which is formed to fit the ball socket 51 in the slipper and enlarged at the inboard end in the base of the piston 40. The hole through the centre acts as a throttle for the oil supply to the slipper bearing face. Optionally the rivet may also retain the filter and piston seal. The advantages of this system are quick assembly, throttling not affected by the slippers lifting off the track ring, and the inability of the piston and slipper to separate in the suction cycle.

The slippers 45 are held out against the track ring during the suction cycle by the slotted band 66 which engages in the radiussed parallel tracks 67 in the slippers (FIG. 9). The slots 68 are long enough to accommodate the relative displacement of the slippers. A circular enlargement 69 may be added to the slot 68 for assembly purposes (FIG. 11).

The band 66 should be of the thinnest possible thickness in the area of the slipper pad. It is preferably produced from slotted spring steel strip cut to length and rolled. It should close to a minimum diameter sufficient to accommodate the required tolerance on the track ring diameter and slipper thickness. This will prevent serious slipper separation from the track ring, whilst in normal operating conditions the spring effect obtained by rolling the band to a larger diameter should hold the slippers tight on to the track ring.

The slots also provide guidance for the slipper pads. If a stiffer band is required than that possible with a plain strip, then the strip may be formed by being rolled into a channel section, the returns being clear of the cylinder barrel and the track ring as shown in FIG. 10. The band 66 is open and discontinuous, the ends being formed with overlapping interlocked fingers which allow contraction and expansion but prevent the band jamming.

The rotary cylinder unit illustrated in FIG. 5 is a unitary one-piece die-casting complete with the central bore, the radial cylinder bores, the flow ports connecting these bores with the central bore, and the drive dogs.

We claim:

1. A radial piston hydraulic machine comprising a rotary cylinder unit provided with generally radial cylinder bores and mounted to rotate on a stationary ported pintle, a piston movable in each cylinder bore and connected to a sliding slipper engaging a surrounding annular cam track, means for transferring hydraulic fluid to and from the ports of the pintle, the cylinder bores communicating with respective ports within the internal surface of the rotary cylinder unit, arranged to co-operate successively with the ports of the pintle as the cylinder unit rotates, and including a common flexible, resilient, non-continuous guide band surrounding said rotary cylinder unit, and acting resiliently on said slippers in a radial direction in relation to the cam track, the guide band having apertures for the individual slippers and intervening bridges, said band having inturned flanges along opposite edges.

2. A radial piston hydraulic machine comprising a rotary cylinder unit provided with generally radial cylinder bores and mounted to rotate on a stationary ported pintle, a piston movable in each cylinder bore and connected to a sliding slipper engaging a surrounding annular cam track, means for transferring hydraulic fluid to and from the ports of the pintle, the cylinder bores communicating with respective ports within the internal surface of the rotary cylinder unit, arranged to co-operate successively with the ports of the pintle as the cylinder unit rotates, and including a common flexible, resilient, non-continuous guide band surrounding said rotary cylinder unit, and acting resiliently on said slippers in a radial direction in relation to the cam track, the guide band having apertures for the individual slippers and intervening bridges, said band being in one piece, and split at one point with the ends separate, and the ends of the band being formed to prevent the ends moving past one another on contraction of the band.

3. A radial piston hydraulic machine comprising a rotary cylinder unit provided with generally radial cylinder bores and mounted to rotate on a fixed ported pintle supported at one end only, a piston movable in each cylinder bore and connected to a sliding slipper engaging a surrounding annular cam track, means for transferring hydraulic fluid to and from the ports of the pintle, the cylinder bores communicating with respective ports within the internal surface of the rotary cylinder unit, arranged to cooperate successively with the ports of the pintle as the cylinder unit rotates, and including a separately formed ported sleeve positioned within the rotary cylinder unit and rotating therewith and having valve ports arranged to communicate with the ports on the pintle and with the cylinders of the rotary unit, the said valve ports in the pintle being elongate and extended in a circumferential direction, the pintle sleeve being formed with projections to engage a driving coupling.

4. A radial piston hydraulic machine comprising a rotary cylinder unit provided with generally radial cylinder bores and mounted to rotate on a fixed ported pintle supported at one end only, a piston movable in each cylinder bore and connected to a sliding slipper engaging a surrounding annular cam track, means for transferring hydraulic fluid to and from the ports of the pintle, the cylinder bores communicating with respective ports within the internal surface of the rotary cylinder unit, arranged to cooperate successively with the ports of the pintle as the cylinder unit rotates, and including a separately formed ported sleeve positioned within the rotary cylinder unit and rotating therewith and having valve ports arranged to communicate with the ports on the pintle and with the cylinders of the rotary unit, the said valve ports in the sleeve and the ports in the pintle being elongate and extended in a circumferential direction, the end profile of each port in the sleeve being narrowed to a point and extending circumferentially and being offset axially in relation to and overlapping an adjacent narrowed extension of an adjacent port in the sleeve.

* * * * *